US007021464B2

(12) United States Patent
Chen

(10) Patent No.: US 7,021,464 B2
(45) Date of Patent: Apr. 4, 2006

(54) TOOL BOX

(76) Inventor: Chang-Ying Chen, 58, Ma Yuan West St., Taichung (TW)

( * ) Notice: Subject to any disclaimer, the term of this patent is extended or adjusted under 35 U.S.C. 154(b) by 100 days.

(21) Appl. No.: 10/662,925

(22) Filed: Sep. 12, 2003

(65) Prior Publication Data

US 2005/0056559 A1 Mar. 17, 2005

(51) Int. Cl.
*B65D 85/20* (2006.01)

(52) U.S. Cl. ..... 206/379; 206/743; 206/755

(58) Field of Classification Search ..... 206/379, 206/742, 743, 751, 754, 755; 211/69, 70.6
See application file for complete search history.

(56) References Cited

U.S. PATENT DOCUMENTS 2,775,342 A * 12/1956 Smith ..... 206/379
3,074,539 A * 1/1963 Rogovin ..... 206/379
4,006,821 A * 2/1977 Sautter ..... 206/379
4,512,467 A * 4/1985 Knoblauch ..... 206/379
6,415,923 B1 * 7/2002 Chen ..... 206/379
6,547,074 B1 * 4/2003 Chen ..... 206/379

* cited by examiner

*Primary Examiner*—David T. Fidel

(57) ABSTRACT

A tool box includes a base, a top cover pivotally mounted on the base, a receiving rack pivotally mounted in the base for receiving a plurality of hand tools, and a driving lever pivotally mounted in the base and having a first end connected to and driven by the top cover and a second end connected to the receiving rack for moving the receiving rack. Thus, when the top cover is removed from the base, the receiving rack is lifted to the optimum inclined position, so that the user can take the screwdriver tips from the receiving rack easily and conveniently.

12 Claims, 9 Drawing Sheets

TOOL BOX

BACKGROUND OF THE INVENTION

1. Field of the Invention

The present invention relates to a tool box, and more particularly to a removable tool box that facilitates the user removing the hand tool, so that the user can take the hand tool from the tool box easily and rapidly.

2. Description of the Related Art

A conventional tool box comprises a main body having a plurality of receiving portions for receiving and clamping the hand tools, such as the screwdriver tips or the like, and a cover pivotally mounted on the main body. Thus, the user can remove the hand tools from the receiving portions of the main body by pivoting the cover outward relative to the main body. However, the receiving portions are fixed in the main body without movement, thereby causing inconvenience to the user when removing the hand tools from the receiving portions of the main body.

SUMMARY OF THE INVENTION

The primary objective of the present invention is to provide a tool box that facilitates the user removing the hand tool, so that the user can take the hand tool from the tool box easily and rapidly.

Another objective of the present invention is to provide a tool box, wherein when the top cover is entirely removed from the base, the receiving rack is lifted to the optimum inclined position, so that the user can take the screwdriver tips from the receiving rack easily and conveniently.

A further objective of the present invention is to provide a tool box, wherein the pivotal block and the movable block of the receiving rack are separated from each other by the restoring force of the two elastic plates so as to form a larger space, thereby facilitating the user removing the screwdriver tips from the pivotal block and the movable block of the receiving rack.

A further objective of the present invention is to provide a tool box, wherein the secondary receiving rack is moved in concert with the receiving rack by connection of the link, thereby facilitating the user removing the screwdriver tips from the secondary receiving rack.

In accordance with the present invention, there is provided a tool box, comprising:

a base;

a top cover pivotally mounted on the base;

a receiving rack pivotally mounted in the base for receiving a plurality of hand tools; and a driving lever pivotally mounted in the base and having a first end connected to and driven by the top cover and a second end connected to the receiving rack for moving the receiving rack.

Further benefits and advantages of the present invention will become apparent after a careful reading of the detailed description with appropriate reference to the accompanying drawings.

DETAILED DESCRIPTION OF THE INVENTION

Figure 1:
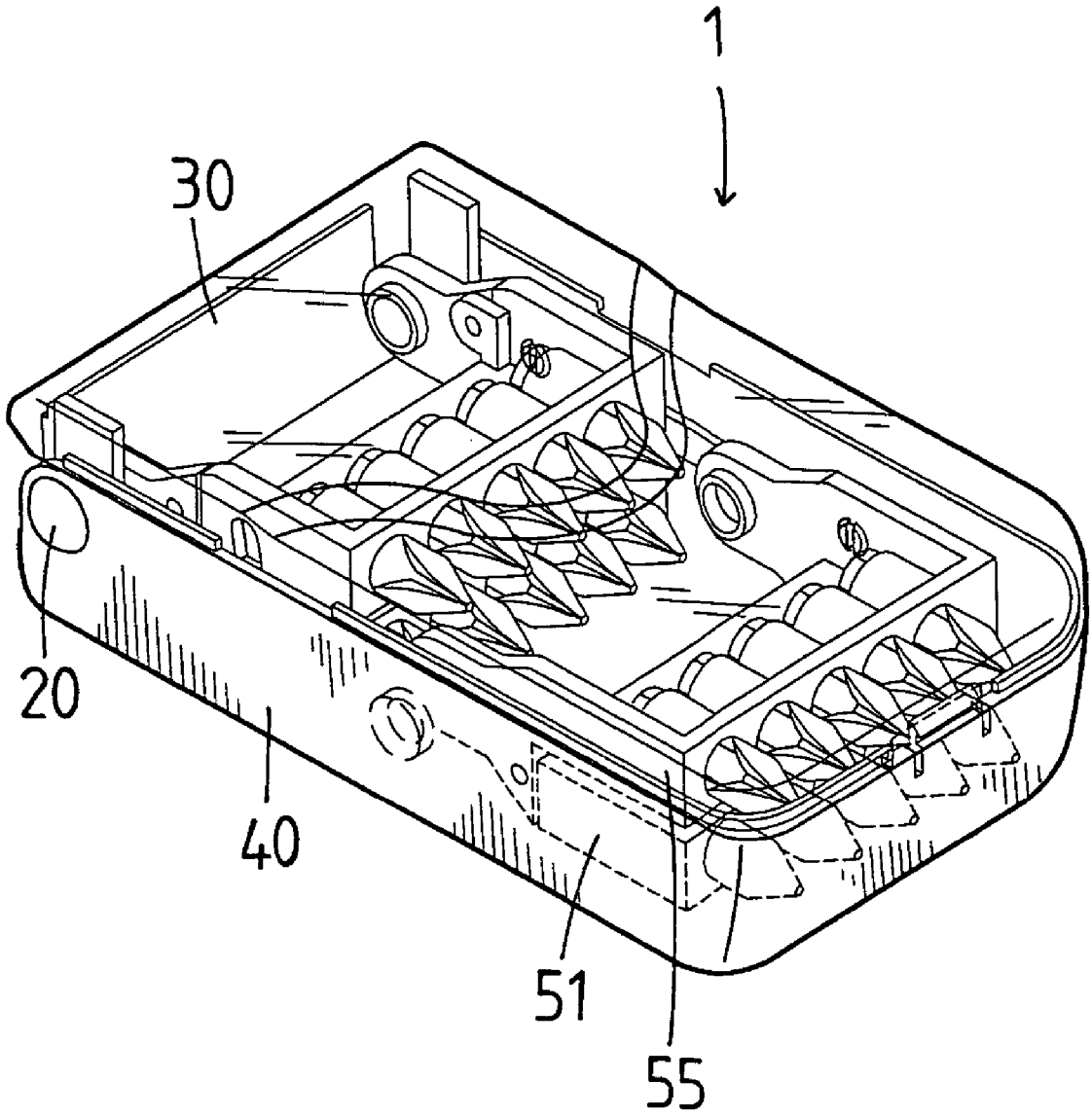
FIG. 1 is a perspective view of a tool box in accordance with the preferred embodiment of the present invention.
Figure 2:
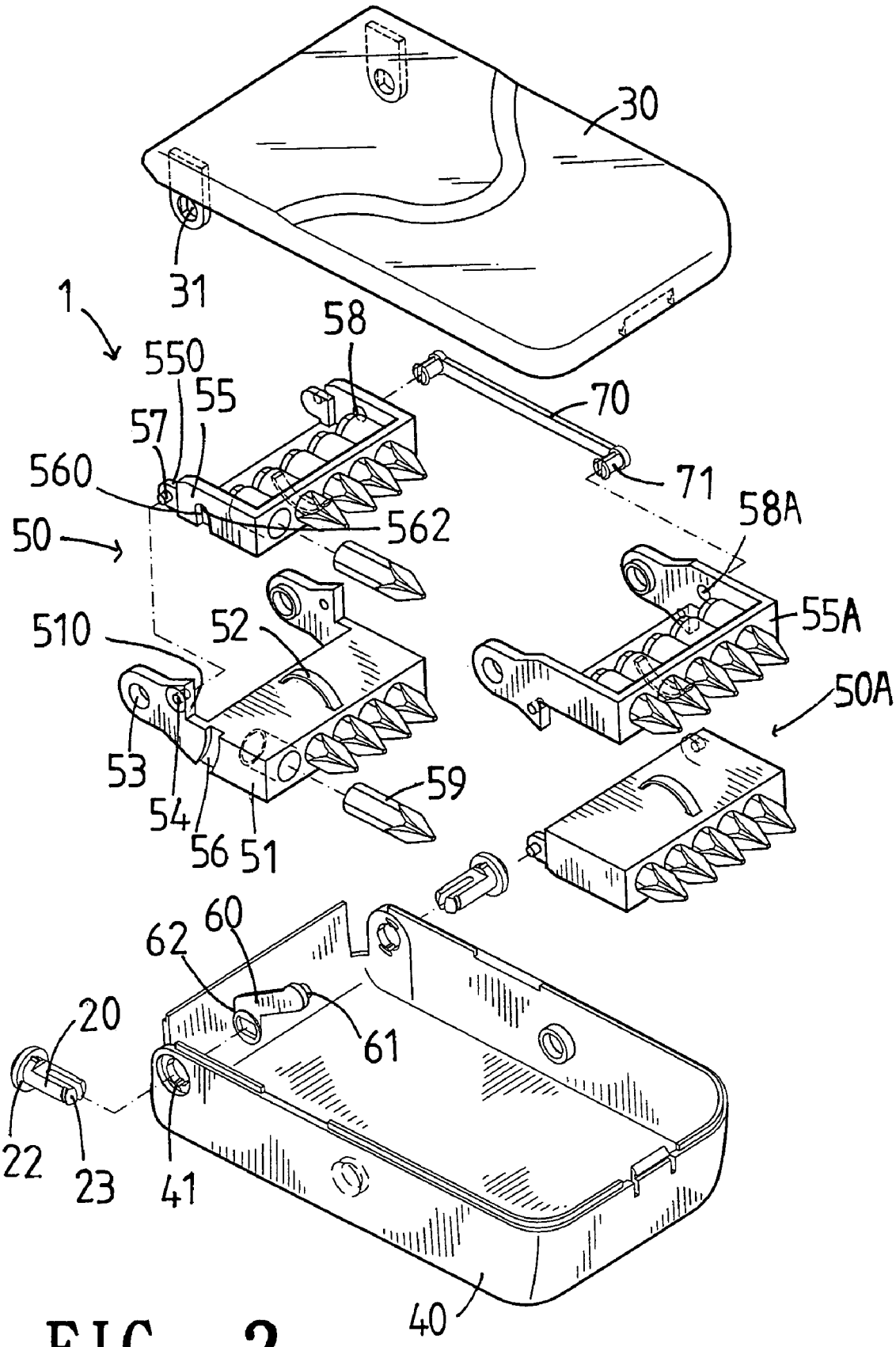
FIG. 2 is an exploded perspective view of the tool box as shown in FIG. 1.
Figure 3:
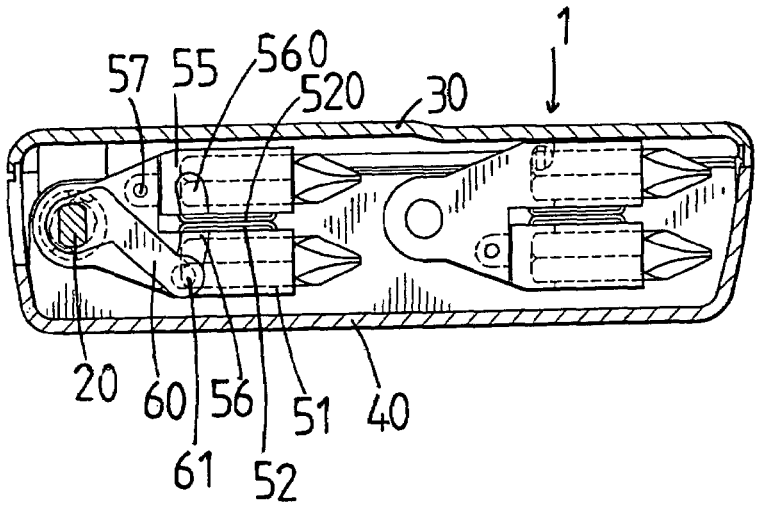
FIG. 3 is a side plan cross-sectional view of the tool box as shown in FIG. 1.

Referring to the drawings and initially to FIGS. 1–3, a tool box in accordance with the preferred embodiment of the present invention comprises a base 40, a top cover 30 pivotally mounted on the base 40, a receiving rack 50 pivotally mounted in the base 40 for receiving a plurality of hand tools, such as the screwdriver tips 59, and a driving lever 60 pivotally mounted in the base 40 and having a first end connected to and driven by the top cover 30 and a second end connected to the receiving rack 50 for moving the receiving rack 50.

The receiving rack 50 includes a pivotal block 51 pivotally mounted in the base 40, and a movable block 55 pivotally mounted on the pivotal block 51.

The base 40 has two sides each formed with a through hole 41, the top cover 30 has two sides each formed with a driving hole 31, the first end of the driving lever 60 is formed with a driven hole 62, the pivotal block 51 of the receiving rack 50 has two sides each formed with a through hole 53, and the tool box further comprises two pivot shafts 20 each extended through the respective through hole 41 of the base 40, the respective driving hole 31 of the top cover 30 and the respective through hole 53 of the pivotal block 51 of the receiving rack 50, and the driven hole 62 of the driving lever 60 is secured on one of the two pivot shafts 20, so that when the top cover 30 is pivoted relative to the base 40, each of the two pivot shafts 20 is rotated by the respective driving hole 31 of the top cover 30 to rotate the driven hole 62 of the driving lever 60 so as to rotate the driving lever 60.

Preferably, the driving hole 31 of the top cover 30 has an oblong shape, the driven hole 62 of the driving lever 60 has an oblong shape, and each of the two pivot shafts 20 has an oblong shape. In addition, each of the two pivot shafts 20 has a first end formed with an enlarged head 22 rested on a wall of the respective through hole 41 of the base 40 and a bifurcated second end formed with two flexible locking hooks 23 each rested on a wall of the respective through hole 53 of the pivotal block 51 of the receiving rack 50.

The pivotal block 51 of the receiving rack 50 has a top provided with an arc-shaped elastic plate 52, and the movable block 55 of the receiving rack 50 has a bottom provided with an arc-shaped elastic plate 520 rested on the elastic plate 52 of the pivotal block 51 of the receiving rack 50.

The pivotal block 51 of the receiving rack 50 has two sides each formed with a through hole 54 and a slide slot 56, and the movable block 55 of the receiving rack 50 has two sides each formed with a pivot axle 57 pivotally mounted in the through hole 54 of the pivotal block 51 of the receiving rack 50 and a slide slot 560 aligning with the slide slot 56 of the pivotal block 51 of the receiving rack 50. In addition, the slide slot 560 of the movable block 55 of the receiving rack 50 has an upper limit 562, and the first end of the driving lever 60 is formed with a stub 61 slidable in the respective slide slot 56 of the pivotal block 51 of the receiving rack 50 and the respective slide slot 560 of the movable block 55 of the receiving rack 50 to abut the upper limit 562 of the respective slide slot 560 of the movable block 55 of the receiving rack 50.

Each of the two sides of the pivotal block 51 of the receiving rack 50 is provided with a resting face 510, and each of the two sides of the movable block 55 of the receiving rack 50 is provided with an urging face 550 rested on the resting face 510 of the pivotal block 51 of the receiving rack 50 when the movable block 55 of the receiving rack 50 is pivoted relative to the pivotal block 51 of the receiving rack 50 to a determined angle.

The tool box further comprises a secondary receiving rack 50A pivotally mounted in the base 40 and connected to the receiving rack 50 by a link 70. The link 70 has two ends each provided with a locking portion 71 inserted into a through hole 58 formed in the movable block 55 of the receiving rack 50 and a through hole 58A formed in the movable block 55A of the secondary receiving rack 50A.

In operation, referring to FIGS. 1–6, the top cover 30 is initially parallel with the base 40 as shown in FIG. 3. At this time, the stub 61 of the driving lever 60 is received in the respective slide slot 56 of the pivotal block 51 of the receiving rack 50 as shown in FIG. 3.

When the top cover 30 is rotated relative to the base 40, the stub 61 of the driving lever 60 is slidable in the respective slide slot 56 of the pivotal block 51 of the receiving rack 50 and the respective slide slot 560 of the movable block 55 of the receiving rack 50.

Figure 4:
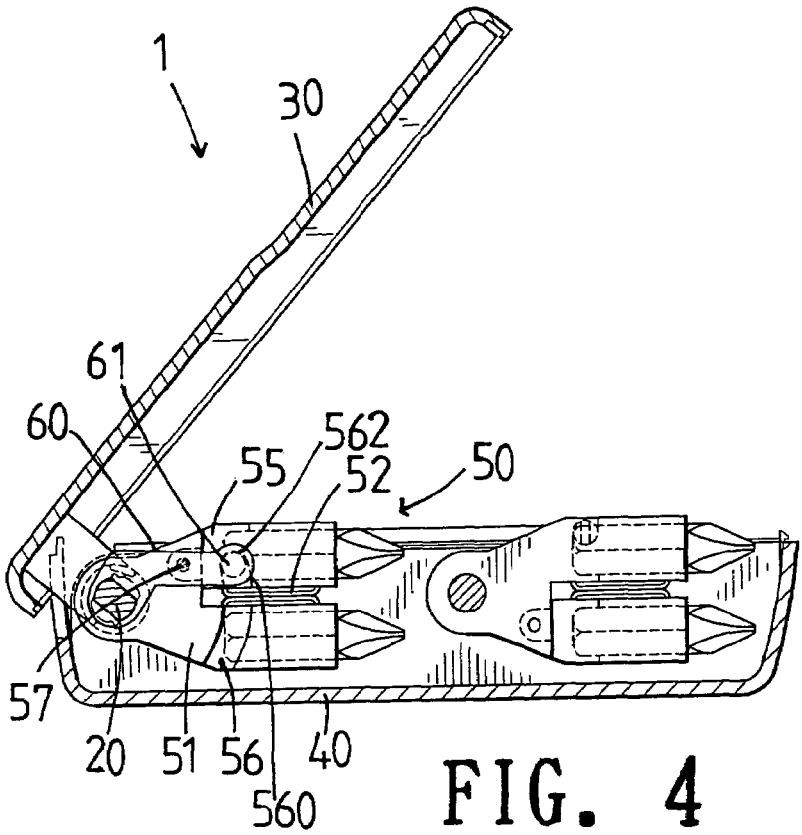
FIG. 4 is a schematic operational view of the tool box as shown in FIG. 3 in use.

When the top cover 30 is rotated relative to the base 40 to the position as shown in FIG. 4 where the included angle between the top cover 30 and the base 40 is about 45 degrees, the stub 61 of the driving lever 60 is rested on the upper limit 562 of the respective slide slot 560 of the movable block 55 of the receiving rack 50.

When the top cover 30 is further rotated relative to the base 40, the receiving rack 50 is driven by the stub 61 of the driving lever 60 to move upward relative to the base 40.

Figure 5:
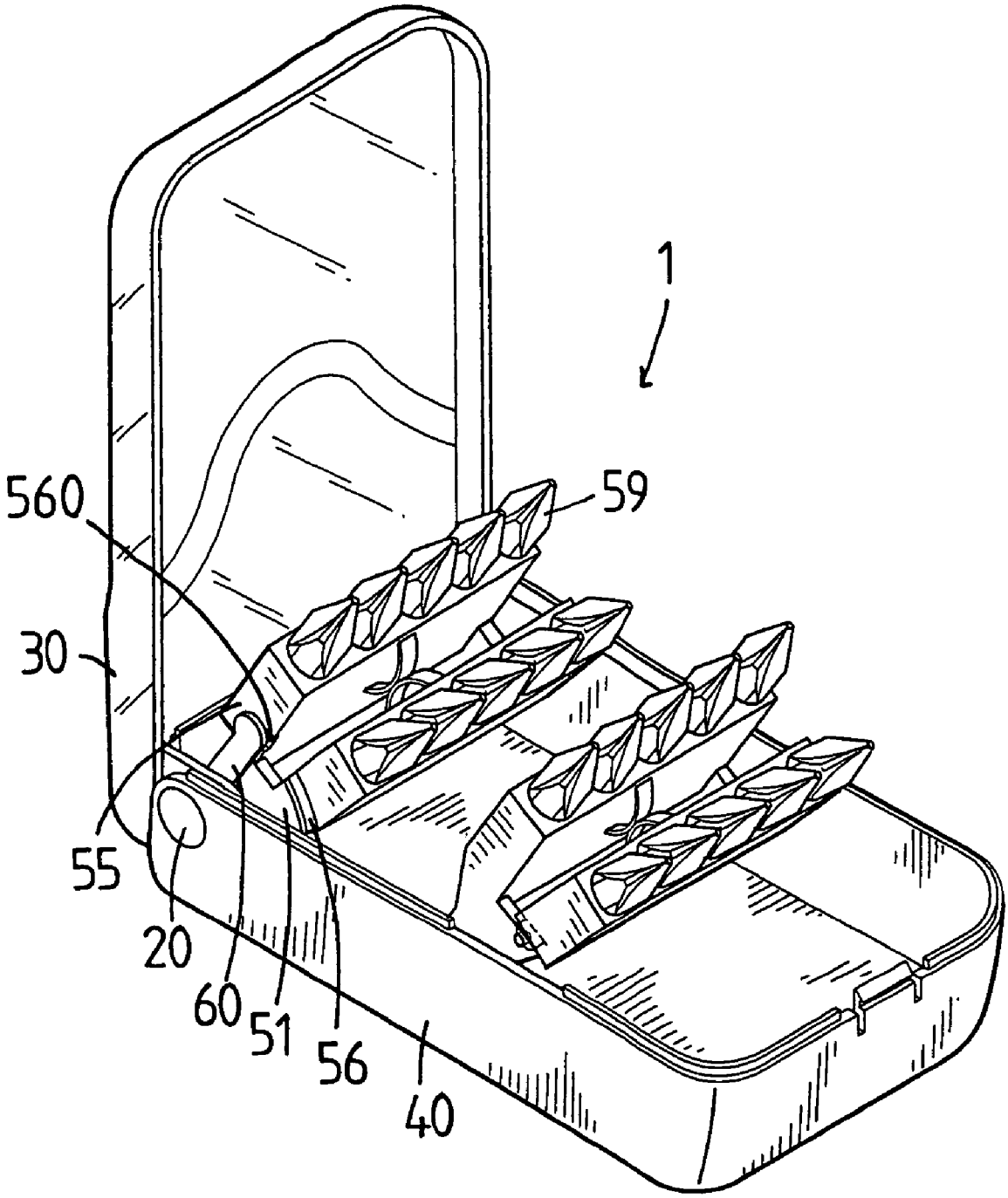
FIG. 5 is a schematic operational view of the tool box as shown in FIG. 1 in use.
Figure 6:
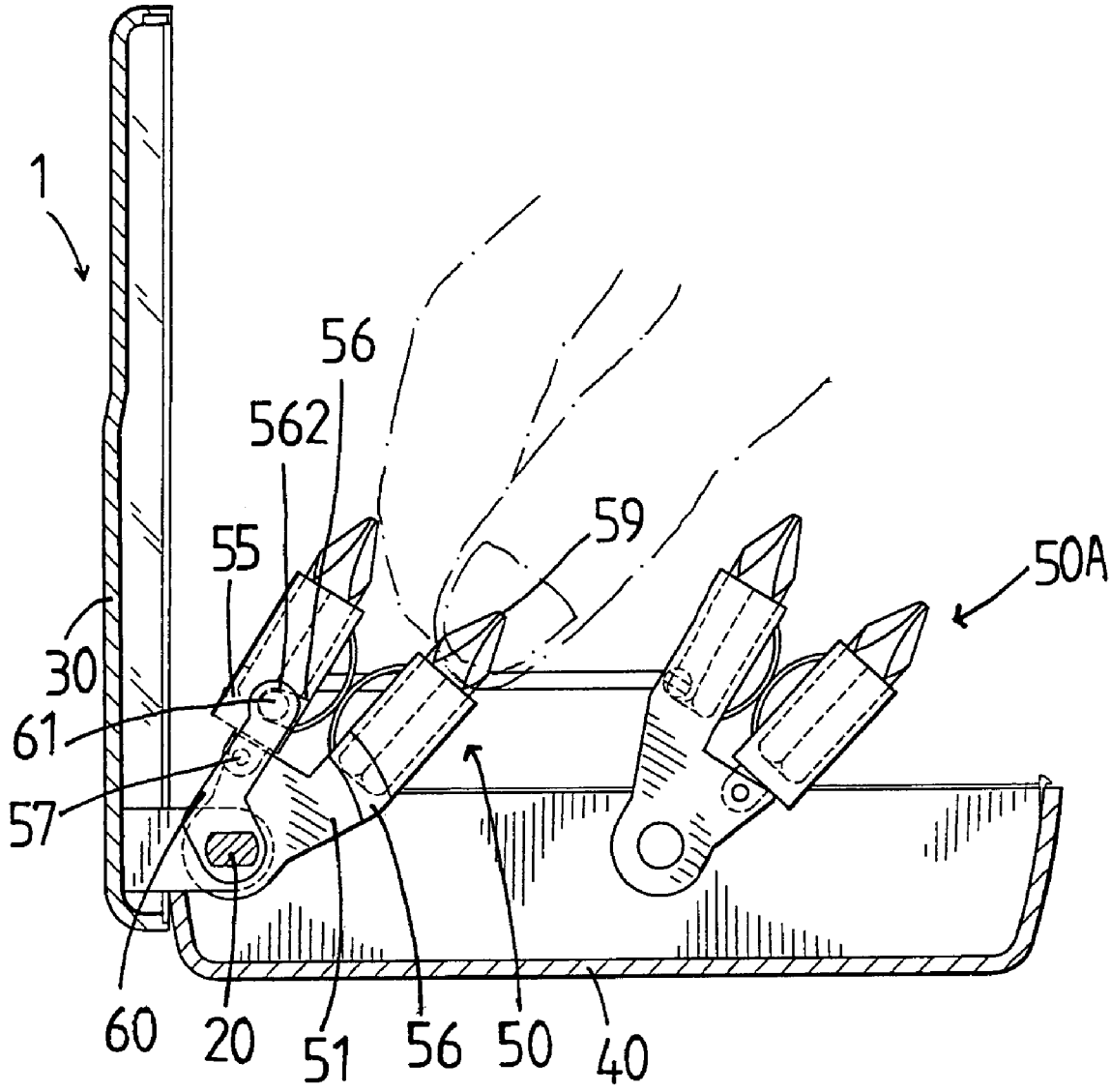
FIG. 6 is a schematic operational view of the tool box as shown in FIG. 4 in use.
Figure 7:
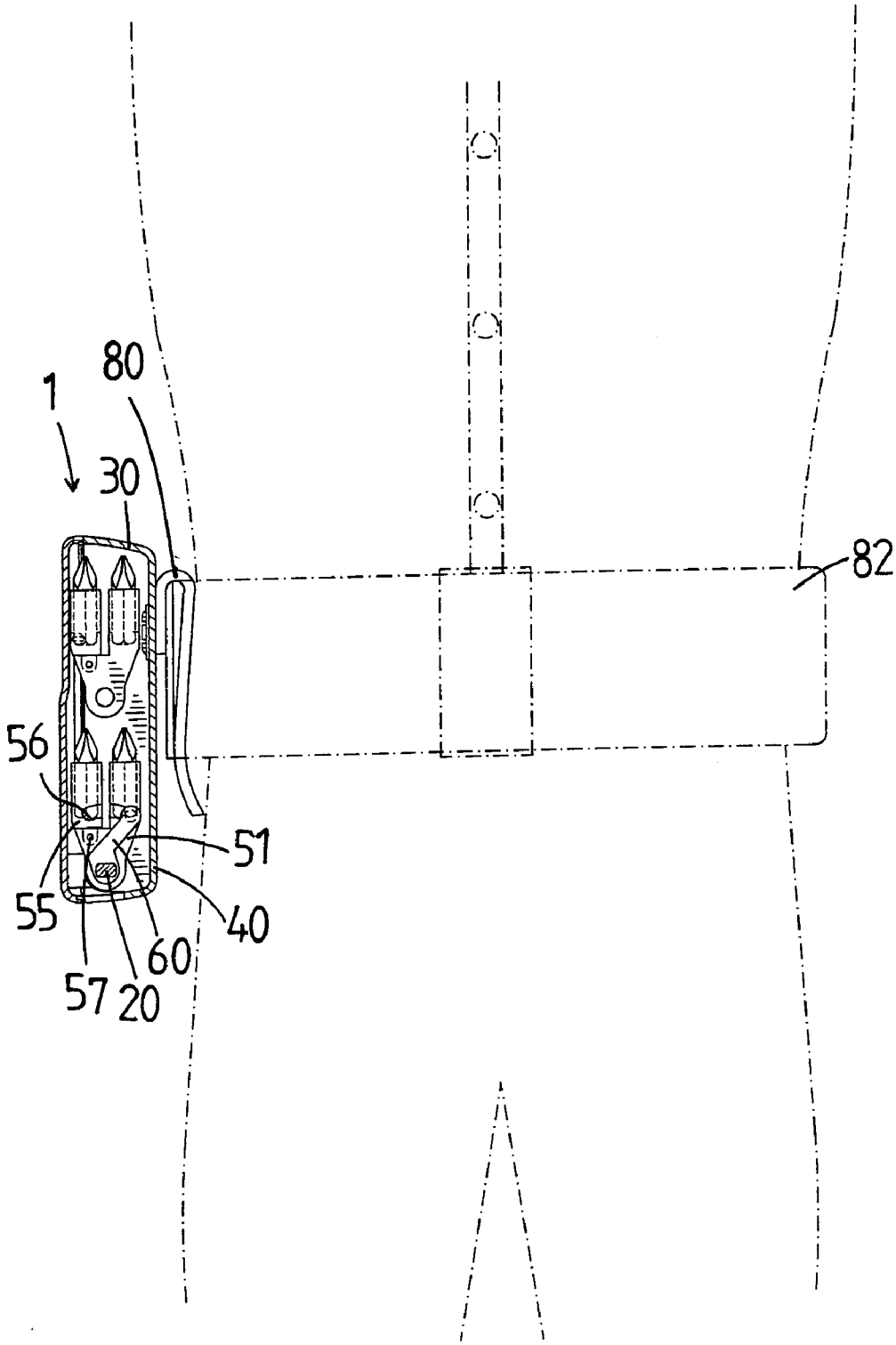
FIG. 7 is a plan cross-sectional view of a tool box in accordance with another embodiment of the present invention.
Figure 8:
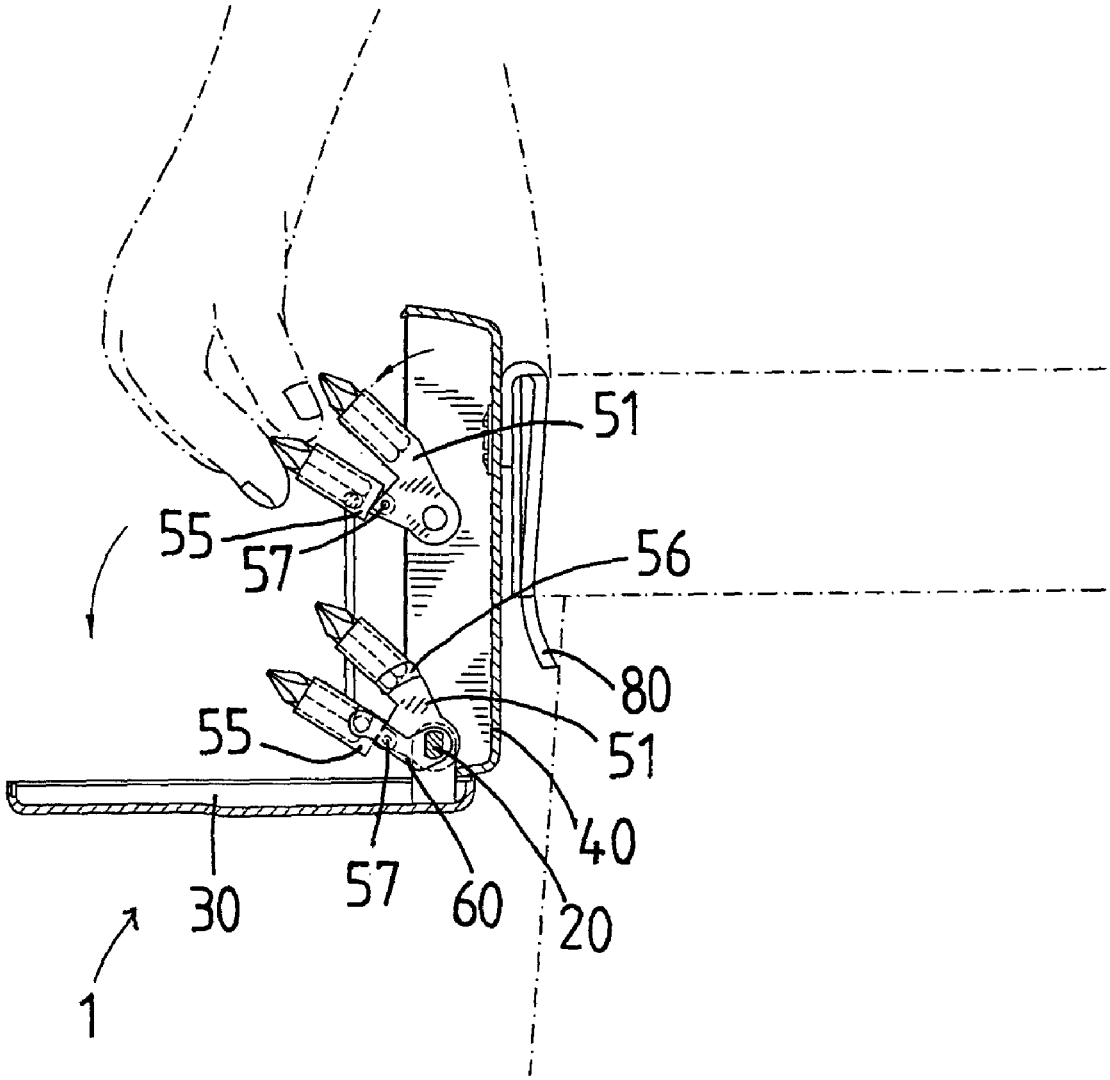
FIG. 8 is a schematic operational view of the tool box as shown in FIG. 7 in use.
Figure 9:
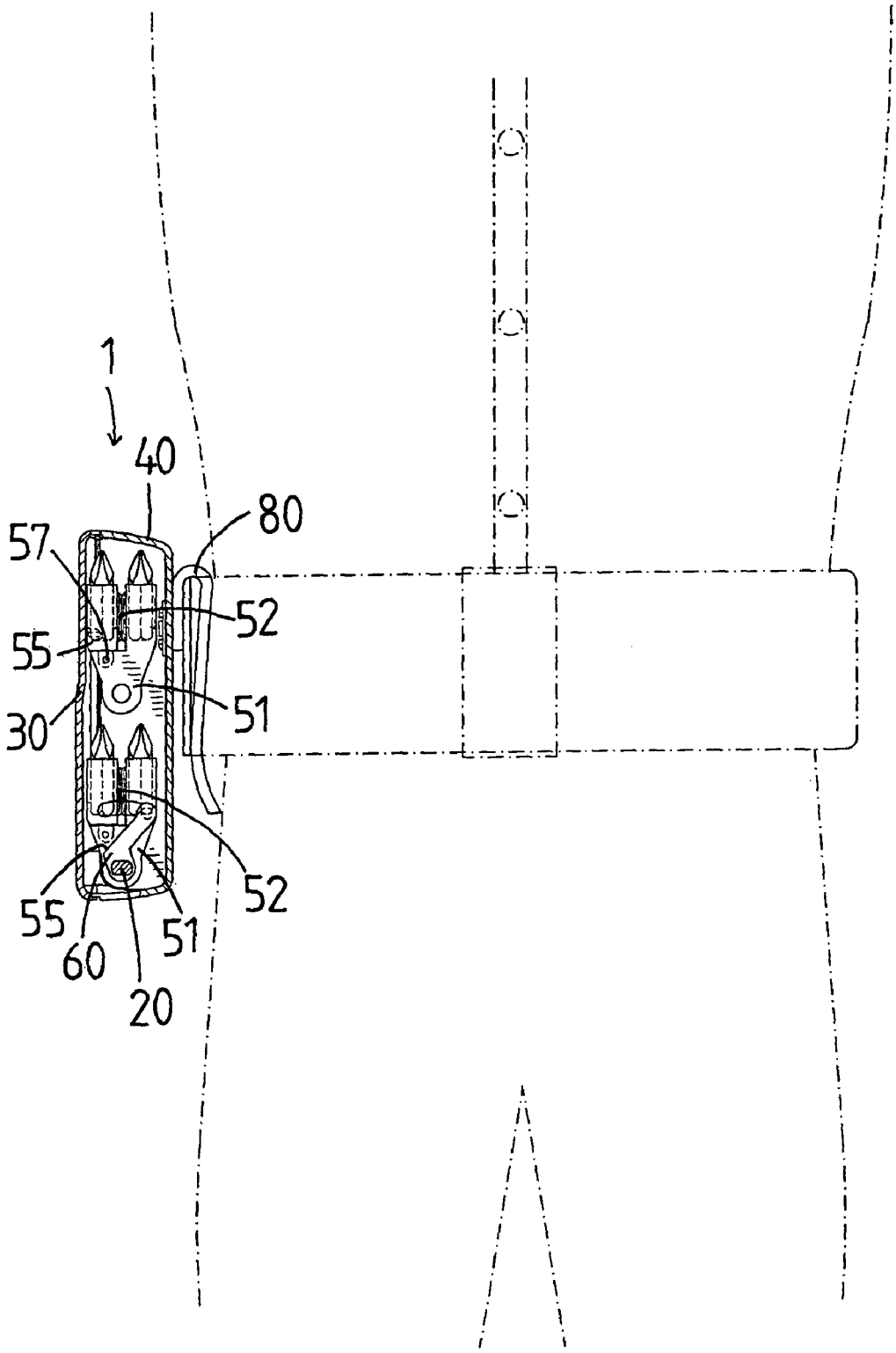
FIG. 9 is a plan cross-sectional view of a tool box in accordance with another embodiment of the present invention.
Figure 10:
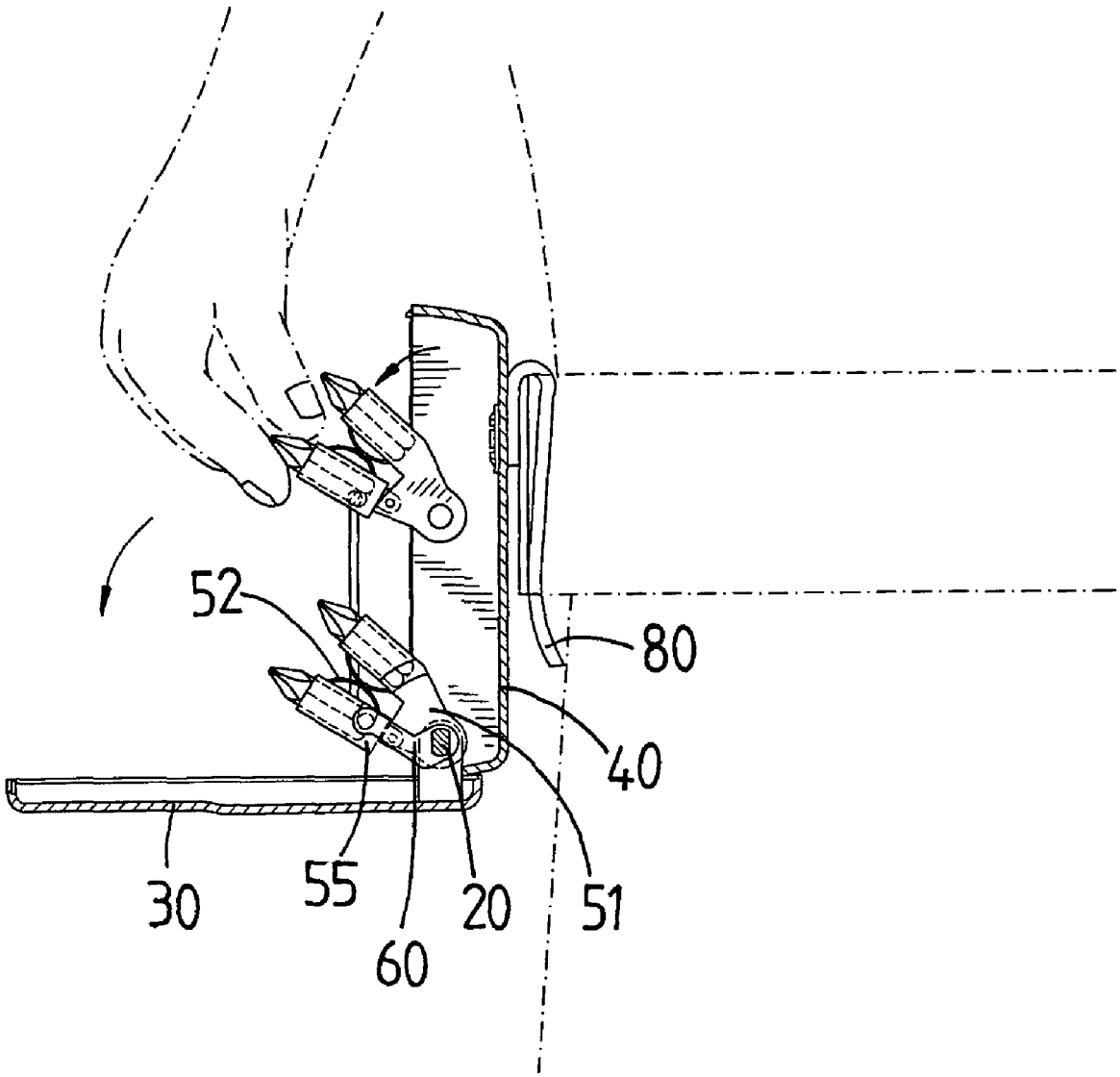
FIG. 10 is a schematic operational view of the tool box as shown in FIG. 9 in use.

Thus, when the top cover 30 is rotated relative to the base 40 to the position as shown in FIGS. 5 and 6 where the included angle between the top cover 30 and the base 40 is about 90 degrees, the receiving rack 50 is moved by the stub 61 of the driving lever 60 to a position where the included angle between the receiving rack 50 and the base 40 is about 45 degrees.

At this time, the pivotal block 51 and the movable block 55 of the receiving rack 50 are separated from each other by the restoring force of the two elastic plates 52 and 520, thereby facilitating the user removing the screwdriver tips 59 from the pivotal block 51 and the movable block 55 of the receiving rack 50.

In addition, when the movable block 55 of the receiving rack 50 is moved by the stub 61 of the driving lever 60, the pivot axle 57 of the movable block 55 of the receiving rack 50 is pivoted in the through hole 54 of the pivotal block 51 of the receiving rack 50, so that the movable block 55 of the receiving rack 50 is pivoted relative to the pivotal block 51 of the receiving rack 50 until the urging face 550 of the movable block 55 of the receiving rack 50 is rested on the resting face 510 of the pivotal block 51 of the receiving rack 50. Then, the pivotal block 51 and the movable block 55 of the receiving rack 50 are moved by the stub 61 of the driving lever 60 simultaneously.

Accordingly, when the top cover 30 is entirely removed from the base 40 as shown in FIG. 6, the receiving rack 50 is lifted to the optimum inclined position, so that the user can take the screwdriver tips 59 from the receiving rack 50 easily and conveniently. In addition, the pivotal block 51 and the movable block 55 of the receiving rack 50 are separated from each other by the restoring force of the two elastic plates 52 and 520 so as to form a larger space, thereby facilitating the user removing the screwdriver tips 59 from the pivotal block 51 and the movable block 55 of the receiving rack 50. Further, the secondary receiving rack 50A is moved in concert with the receiving rack 50 by connection of the link 70, thereby facilitating the user removing the screwdriver tips 59 from the secondary receiving rack 50A.

Referring to FIGS. 7–10, the tool box further comprises a snapping member 80 mounted on a surface of the bas 40, so that the tool box can be attached on the user's waist belt 82.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool box, comprising:

a base;

a top cover pivotally mounted on the base;

a receiving rack pivotally mounted in the base for receiving a plurality of hand tools; and a driving lever pivotally mounted in the base and having a first end connected to and driven by the top cover and a second end connected to the receiving rack for moving the receiving rack:

wherein the receiving rack includes a pivotal block pivotally mounted in the base, and a movable block pivotally mounted on the pivotal block; and wherein the base has two sides each formed with a through hole, the top cover has two sides each formed with a driving hole, the first end of the driving lever is formed with a driven hole, the pivotal block of the receiving rack has two sides each formed with a through hole, and the tool box further comprises two pivot shafts each extended through the respective through hole of the base, the respective driving hole of the top cover and the respective through hole of the pivotal block of the receiving rack, and the driven hole of the driving lever is secured on one of the two pivot shafts, so that when the top cover is pivoted relative to the base, each of the two pivot shafts is rotated by the respective driving hole of the top cover to rotate the driven hole of the driving lever so as to rotate the driving lever.

2. The tool box in accordance with claim 1, wherein the driving hole of the top cover has an oblong shape.

3. The tool box in accordance with claim 1, wherein the driven hole of the driving lever has an oblong shape.

4. The tool box in accordance with claim 1, wherein each of the two pivot shafts has an oblong shape.

5. The tool box in accordance with claim 1, wherein each of the two pivot shafts has a first end formed with an enlarged head rested on a wall of the respective through hole of the base and a bifurcated second end formed with two flexible locking hooks each rested on a wall of the respective through hole of the pivotal block of the receiving rack.

6. A tool box, comprising:

a base;

a top cover pivotally mounted on the base;

a receiving rack pivotally mounted in the base for receiving a plurality of hand tools; and a driving lever pivotally mounted in the base and having a first end connected to and driven by the top cover and a second end connected to the receiving rack for moving the receiving rack;

wherein the receiving rack includes a pivotal block pivotally mounted in the base, and a movable block pivotally mounted on the pivotal block; and wherein the pivotal block of the receiving rack has a top provided with an arc-shaped elastic plate, and the movable block of the receiving rack has a bottom provided with an arc-shaped elastic plate rested on the elastic plate of the pivotal block of the receiving rack.

7. A tool box, comprising:

a base;

a top cover pivotally mounted on the base;

a receiving rack pivotally mounted in the base for receiving a plurality of hand tools; and a driving lever pivotally mounted in the base and having a first end connected to and driven by the top cover and a second end connected to the receiving rack for moving the receiving rack;

wherein the receiving rack includes a pivotal block pivotally mounted in the base, and a movable block pivotally mounted on the pivotal block; and wherein the pivotal block of the receiving rack has two sides each formed with a slide slot, the movable block of the receiving rack has two sides each formed with a slide slot aligning with the slide slot of the pivotal block of the receiving rack, and the first end of the driving lever is formed with a stub slidable in the respective slide slot of the pivotal block of the receiving rack and the respective slide slot of the movable block of the receiving rack.

8. The tool box in accordance with claim 7, wherein the slide slot of the movable block of the receiving rack has an upper limit, and the stub of the driving lever is rested on the upper limit of the respective slide slot of the movable block of the receiving rack.

9. The tool box in accordance with claim 7, wherein when the top cover is parallel with the base, the stub of the driving lever is received in the respective slide slot of the pivotal block of the receiving rack.

10. The tool box in accordance with claim 7, wherein when the top cover is rotated relative to the base, the stub of each of the driving lever is slidable in the respective slide slot of the pivotal block of the receiving rack and the respective slide slot of the movable block of the receiving rack.

11. The tool box in accordance with claim 8, wherein when the top cover is rotated relative to the base to a position where the included angle between the top cover and the base is about 45 degrees, the stub of the driving lever is rested on the upper limit of the respective slide slot of the movable block of the receiving rack.

12. The tool box in accordance with claim 7, wherein when the top cover is rotated relative to the base to a position where the included angle between the top cover and the base is about 90 degrees, the receiving rack is moved by the stub of the driving lever to a position where the included angle between the receiving rack and the base is about 45 degrees.

* * * * *